United States Patent [19]

Bennett et al.

[11] 4,033,108

[45] July 5, 1977

[54] AUTOMATIC CUT-OFF SETTING SYSTEM FOR LED DISPLAY IN A SOLID-STATE WATCH

[75] Inventors: William O. Bennett, Bayside; Robert F. Sagarino, Wheatley Heights, both of N.Y.

[73] Assignee: Bulova Watch Company, Inc., New York, N.Y.

[22] Filed: Mar. 2, 1976

[21] Appl. No.: 663,139

[52] U.S. Cl. ..... 58/50 R; 58/23 R; 58/85.5

[51] Int. Cl.[2] ..... G04B 19/30; G04C 3/00

[58] Field of Search ..... 58/23 R, 50 R, 85.5

[56] References Cited

UNITED STATES PATENTS

| | | | |
|---|---|---|---|
| 3,768,247 | 10/1973 | Fujita | 58/23 R |
| 3,795,098 | 3/1974 | Fujita | 58/85.5 |
| 3,810,356 | 5/1974 | Fujita | 58/23 R |
| 3,953,964 | 5/1976 | Suppa et al. | 58/50 R |
| 3,994,124 | 11/1976 | Fujita | 58/23 R |

*Primary Examiner*—Stanley J. Witkowski

[57] ABSTRACT

A solid-state electronic watch having a battery-operated multi-digit display of the light-emitting diode type. In the Normal-mode of the watch, the display is quiescent to conserve power and prolong the life of the battery. A depressible Time-button switch is provided which, in the Time-mode, causes the display to present different functions of time, such as Hours-Minutes and Month-Date, depending on how the button is actuated by the user. A depressible Set-button switch is also provided. This switch, when repeatedly depressed and released by the user presents in sequence the individual readings to be set, such as Hours, Minutes and Date. The particular reading presented on the display by operation of the Set-button is advanced by actuating the Time-button. An automatic cut-off system is provided which in the Time-mode acts to discontinue the LED display immediately or shortly after the Time-button is released and in the Set-mode acts to discontinue the LED display shortly after the Set-button is released, whereby the watch always reverts to its Normal-mode regardless of how these buttons are operated.

7 Claims, 14 Drawing Figures

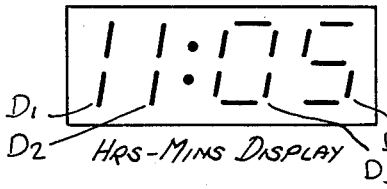
HRS-MINS DISPLAY
Fig.3.
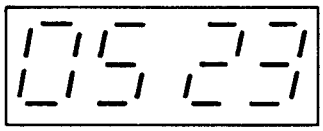
MIN-SEC DISPLAY
Fig.4.
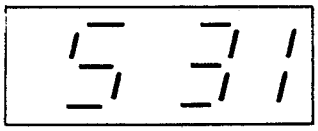
MONTH-DATE DISPLAY
Fig.5.
HOURS SET MODE
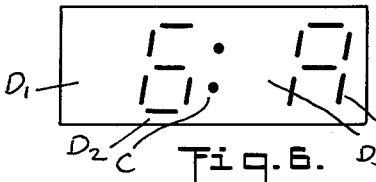
Fig.6.
MINUTES SET MODE
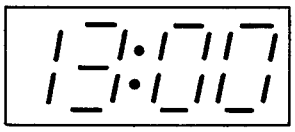
Fig.7.
MONTHS SET MODE
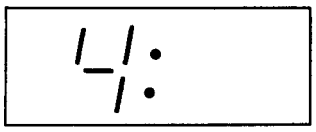
Fig.8.
Fig.9.
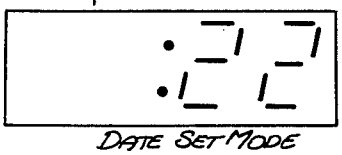
DATE SET MODE
Fig.10.
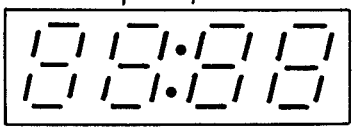
DISPLAY TEST
HOURS SET, MONTHS SET, DAYS SET
Fig.13.
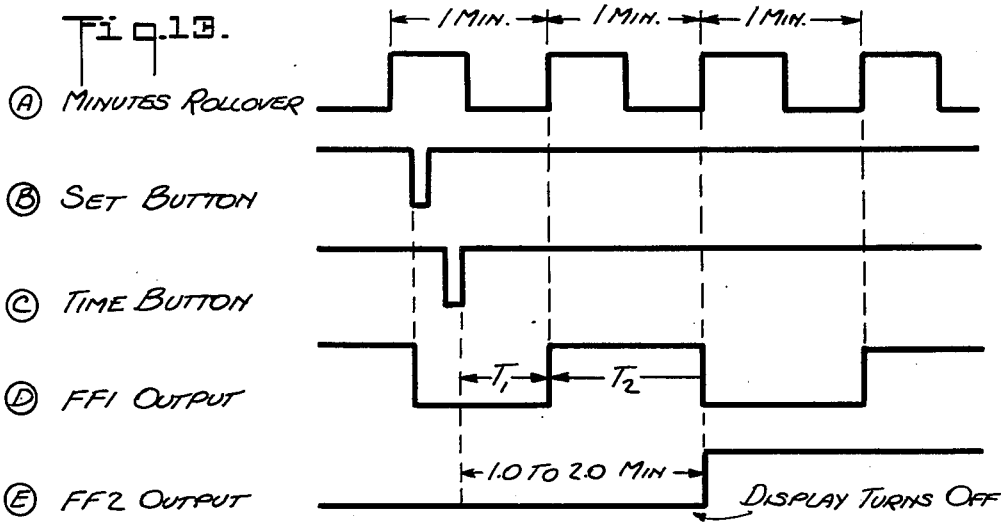
MINUTES SET:
Fig.14.
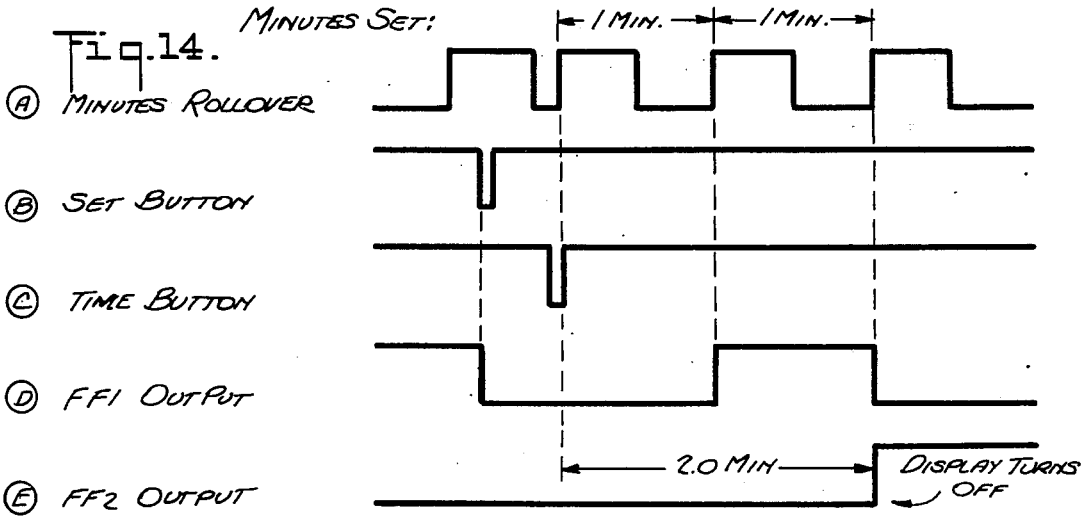

AUTOMATIC CUT-OFF SETTING SYSTEM FOR LED DISPLAY IN A SOLID-STATE WATCH

BACKGROUND OF THE INVENTION

This invention relates generally to solid-state electronic timepieces having an electro-optic display formed by light-emitting read-out elements and capable of selectively presenting different functions of time in a Time-mode, each of which is settable in a Set-mode, and more particularly to a solid-state timepiece in which the display in either mode automatically shuts off.

The term solid-state electronic timepiece, as used herein, is limited to timepieces provided with an electro-optic time display and having no moving parts.

In one well-known form of a solid-state electronic watch, electrical pulses derived from a crystal-controlled time base serve to actuate a multi-digit, electro-optic display formed by light-emitting diodes (LED). In such solid-state watches, the high-frequency output of the time base is fed to a frequency converter constituted by a chain of integrated-circuit divider stages. The low-frequency timing pulses yielded in the output of the frequency converter are applied to a display actuator in the form of a miniature time-computer module that counts the input pulse train, encodes it in binary form and then decodes and processes the results so as to provide the appropriate indications at the several display stations.

In a solid-state watch having an LED display, the power requirements for the display are quite high; hence should the display be kept on continuously, the life of the battery would be brief. It is for this reason that commercially available solid-state watches having an LED display are provided with a normally quiescent display that is turned on only when the user depresses a push-button demand switch, thereby conserving power and prolonging the life of the battery.

In one such LED watch, as disclosed, for example, in U.S. Pat. No. 3,756,013, the LED display is programmed so that upon merely touching the push-button switch, the minutes and hours are indicated for an interval of one and one-quarter seconds, whereas continued depression of the switch causes the minutes and hour data to fade and the seconds to appear, the seconds continuing to count as long as the demand button is held in. In this solid-state timepiece, precise computation or time is continuous and independent of whether or not it is displayed, so that the moment the swtich is depressed, timing signals are applied to the display.

In solid-state watches of the type disclosed, for example, in U.S. Pat. Nos. 3,756,013 and 3,759,031, setting of the various readings is accomplished by separate switches, one for "hours" and the other for "minutes." The term "reading" as used herein, as distinguished from function, refers to a single component of a function. Thus an Hours-Minutes function is composed of an Hours reading and a Minutes reading. These setting switches are actuated by inserting a probe in a recess giving access thereto. When the hours set switch is operated, the hours read-out advances rapidly without disturbing the setting of the minutes and seconds. When the minutes setting switch is actuated, the seconds are automatically zeroed, while the minutes are advanced to the desired setting. When the probe is withdrawn, the setting switch is de-activated. When the display includes other time functions such as the calendar month and date, still other switches are required.

The need for a separate, mechanically actuated setting switch for each of several time function unduly complicates the watch structure and makes it difficult for the user to carry out setting operations. To avoid this difficulty, it is known to use a single, button-operated switch for setting all of the time functions. An example of this type of solid-state watch is the LSI-010 LED watch movement manufactured by LSI Systems, Inc., of Sunnyvale, Calif. (hereinafter referred to as the LSI movement), this movement being incorporated in watches sold under various commercial brand names.

The LSI movement is a multiplexed, four-digit, solid-state device that displays, on demand, the following three time functions in digital terms: Hours-Minutes, Minutes-Seconds, and Month-Date. Only a single so-called Time-button switch is required in the Time-mode to select any one of these functions. A momentary depression of the Time-button brings about a four-digit display of Hours-Minutes with a colon therebetween. After a predetermined brief dwell period (1.5 to 2.0 seconds). The Hours-Minutes display turns off automatically, the watch reverting to its Normal-mode in which the display is quiescent but the computer continues to operate.

If the Time-button is pressed in and then held, the Hours-Minutes will be presented for the brief dwell period, after which it is replaced by a display of Minutes-Seconds. This Minutes-Seconds display will continue until the Time-button is released.

But if the Time-button is first pressed in momentarily to produce the Hours-Minutes display and the button is again pressed in before the dwell period associated with this display runs out, the Hours-Minutes display will be replaced by a Month-Date presentation which remains on until the Time-button is released. However, if the second depression of the Time-button is momentary, the Month-Date presentation will stay on for a predetermined dwell period (1.5 seconds) and then turn off automatically.

Hence with respect to the various time display functions, once the Time-button of the LSI movement is released, the display will either shut off immediately or turn off automatically when the dwell period associated with the particular time function then in effect runs out. There is no danger, therefore, when operating in the Time-mode that the display will remain on and proceed to drain the battery by reason of the user's failure to operate the Time-button correctly.

However, this danger does exist in the Set-mode of an LSI movement or with a solid-state watch having a similar setting system. The LSI movement, in addition to the Time-button, includes a Set-button which permits simple and precise time synchronization and simple hour changes for time zone and daylight savings time.

In the Set-mode, pressing and releasing the Set-button once will cause the Hours alone to appear on the display. If now the Time-button is pressed, each depression thereof will cause the Hours to advance one count. Hence to set the Hours, one repeatedly presses the Time-button until the correct hour appears on the display. When, thereafter, the Set-button is again pressed and released, the Minutes and Seconds will then appear on the display. In this setting state, each depression of the Time-button will cause the Minutes to advance one count and the Seconds to reset to zero.

Pressing and releasing the Set-button of the LSI movement three times puts the setting system into the Months state and bring about a display of the number of the month. Thereafter, each depression of the Time-button causes the number of the month to advance one count. Pressing and releasing the Set-button four times will cause the Date to be displayed. Thereafter, each depression of the Time-button will advance the date one count.

Pressing and releasing the Set-button five times will cause the digits at each station of the LED display to present all of its segments. Since each LED is made up of seven segments, the number 8 is presented at each station. The purpose of the display is to show whether all LED segments at all four stations are in working condition. Hence this state in the Set-mode is the test state.

Pressing and releasing the Set-button six times causes it to revert to its Normal-mode. Thus in the Set-mode, the number of times the Set-button is successively pressed-in and released determines the setting state in effect, and by actuating the Set-button six times one goes through a cycle of five setting states, followed by a return to the Normal-mode.

Once the display is back in the Normal-mode, then regardless of how carelessly the Time-button is operated by the user, the display will, as explained previously, always turn off automatically either the moment the Time-button is released or shortly thereafter. But in the Set-mode, the failure to return the display to the Normal-mode after carrying out a setting operation may be fatal to the life of the battery powering the LED display.

For example, if after actuating the Set-button four times to put the display in the Date-setting state, the user is distracted and forgets to return the display to the Normal-mode but continues to wear the watch, the display will then remain on continuously in this setting state. As a consequence, current from the battery for the LED display will be drawn uninterruptedly, and the battery will be exhausted in a matter of hours.

A more typical situation involving the Set-button is the jeweler who stocks such solid-state watches and has occasion to demonstrate the question thereof to potential customers. There is a fair chance that the busy or throughtless jeweler, after explaining to his prospect how the setting system operates will thereafter return the watch to stock in the Set-mode. As a result, the next time the jeweler has occasion to make a demonstration he will find that the watch is inoperative.

SUMMARY OF INVENTION

In view of the foregoing, it is the main object of this invention to provide a solid-state watch having a battery-powered LED digital display whose various readings are settable by means of a depress-and-release Set-button switch, the particular reading presented by actuation of the switch being automatically turned off after a predetermined period to conserve battery power.

More particularly, it is an object of the invention to provide a watch of the above-type which is selectively controlled in the Time-mode by a depressible Time-button switch to present different functions of time, and is selectively controlled in the Set-mode by a depress-and-release Set-button switch to present the different readings to be set, the display in the Time-mode being automatically turned off after a brief period following release of the Time-button switch, the display in the Set-mode being automatically turned off upon the expiration of a predetermined hold period which is initiated upon actuation of the Set-button.

A significant feature of the invention is that only two buttons are required to control the display to present any one of several time functions and to set the readings which make up these functions, thereby avoiding the need for a multiplicity of control switches. While the user, to operate the watch properly, must actuate the buttons in a particular manner, his careless or inadvertent actuation of these buttons is never fatal to the life of the battery for the LED display, for regardless of how the buttons are actuated, the display will always be turned of automatically, so that the watch is fail-safe and always reverts to the Normal-mode.

Briefly stated, these objects are attained in a battery-operated solid-state watch having LED display stations which are quiescent when the watch operates in its Normal-mode. Operation in the Time-mode is effected by means of a releasable time-button switch which, when actuated, causes different functions of time to be displayed, such as Hours-minutes and Minutes-Seconds.

Operation in the Set-mode is effected by means of a releasable set-button switch, which when repeatedly pressed and released by the user, brings about the sequential display of the individual readings to be set, such as Hours, Minutes and Days. The particular reading presented on the display is advanced by actuating the time-button.

An automatic cut-off system is provided which in the Time-mode acts to discontinue the LED display immediately or shortly after the Time-button is released and in the Set-mode acts to discontinue the display shortly after the Set-button is released, whereby the watch always reverts to its Normal-mode regardless of how the releasable buttons are manipulated by the user.

OUTLINE OF DRAWING

For a better understanding of the invention as well as other objects and further features thereof, reference is made to the following detailed description to be read in conjunction with the accompanying drawings, wherein:

FIG. 3 shows an Hours-Minutes display in the Time-mode;

FIG. 4 shows a Minutes-Seconds display in the Time-mode;

FIG. 5 shows a Month-Date display in the Time-mode;

FIG. 6 illustrates an Hours reading in the Set-mode;

FIG. 7 shows a Minutes reading in the Set-mode;

FIG. 8 shows a Month reading in the Set-mode;

FIG. 9 shows a Date reading in the Set-mode;

FIG. 10 shows the test state in the Set-mode;

FIG. 12 separately shows the cut-off circuit for the Set-mode;

FIG. 13 is a timing diagram of the Cut-off circuit when setting Hours, Months or Days; and FIG. 14 is the timing diagram of the cut-off circuit when setting Minutes.

DESCRIPTION OF INVENTION

The Basic System

Figure 1:
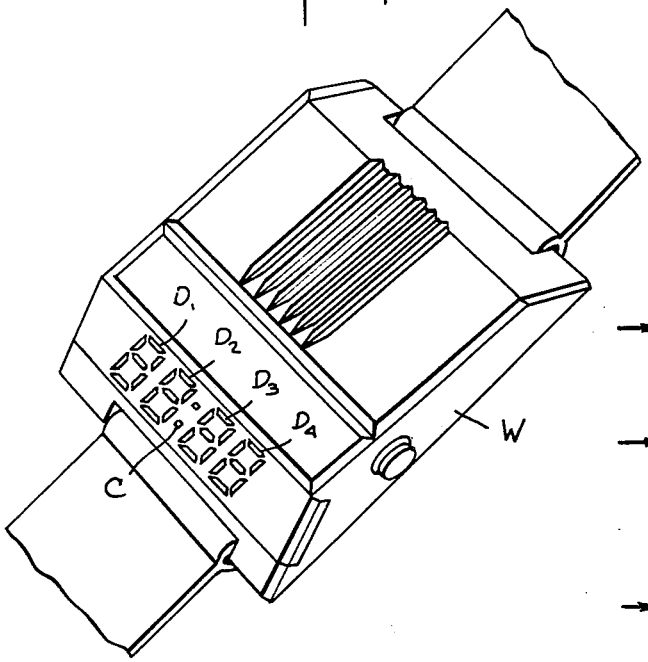
FIG. 1 is a perspective view of a preferred embodiment of a watch in accordance with the invention.
Figure 1A:
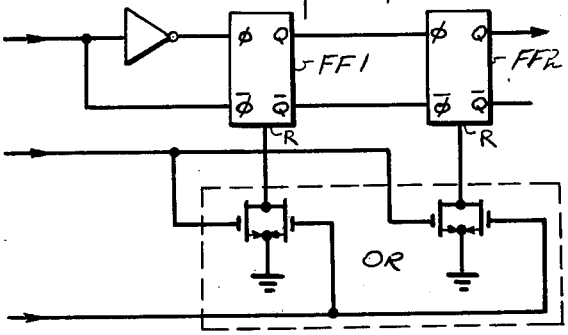

Referring now to FIG. 1, there is shown a preferred embodiment of a cased solid-state watch W in accordance with the invention, the watch display being constituted by a row of four light-emitting diode (LED) stations $D_1$, $D_2$, $D_3$ and $D_4$, with a colon C interposed between the second and third stations to distinguish between hours and minutes.

Figure 2:
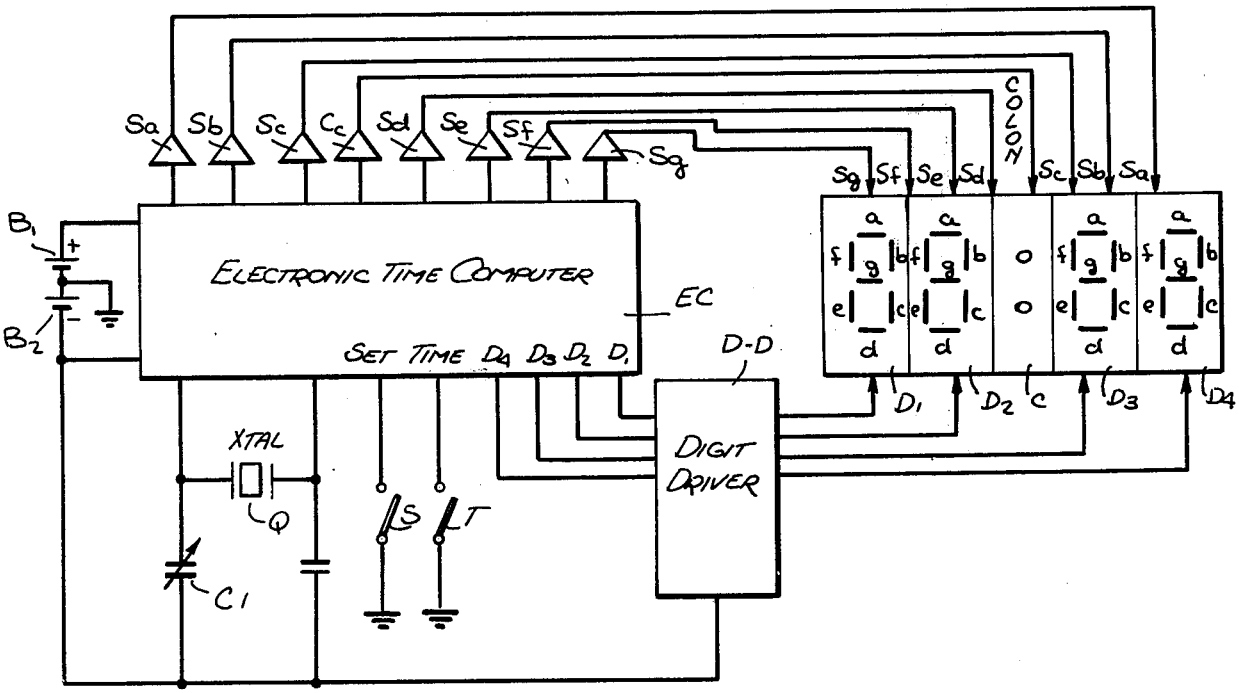
FIG. 2 is a simplified block diagram of the watch movement.

Each LED station, as best seen in FIG. 2, is formed by seven segments, *a* to *g*, such that by selectively exciting these segments, one can form the digits 0 to 9. Thus to form a 0, all segments except segment *g* are energized, and to form a 3, all segments other than segments *f* and *e* are energized. The letter A, to represent AM time, is produced by exciting all segments other than segment *d*, and the letter P to represent PM time is created by exciting all segments other than segments *c* and *d*.

The respective segments *a* to *g* of the four stations $D_1$ to $D_4$ are actuated by individual segment drivers S*a* to S*g* and the colon C by colon driver $C_c$. The selective actuation of digit stations is effected by a digit driver DD. The various drivers are controlled by a miniature electronic time computer EC whose operation is governed in the Time-mode by a push-button switch T and in the Set-mode by a push-button switch S acting in conjunction with button T.

As will later be explained in greater detail, the time computer includes a high-frequency, crystal-controlled time base provided with an external quartz crystal element Q whose frequency is adjusted by a trimmer capacitor $C_1$. The time base output is divided down to produce low-frequency timing pulses which are applied to a chain of seconds, minutes, hours, days and months counters whose respective outputs provide the necessary signals for actuating the display.

The switch buttons T and S operate in conjunction with a display control logic and a setting control logic. The movement is powered by two miniature battery cells $B_1$ and $B_2$. In order to conserve power, the Normal-mode of the watch is one in which computer EC always functions to measure time, but the display is unactuated, so that the relatively heavy current drain resulting from LED operation is reserved for those brief intervals in the Time-mode and the Set-mode when the user consults the display.

The arrangement is such that in the Time-mode, one can, by operating button T, present, on demand, the Hours-Minutes, such as 11:05, shown in FIG. 3, the mInutes-Seconds, such as 0523, shown in FIG. 4, and the Month-Date, such as 531, shown in FIG. 5.

To present Hours-Minutes, the Time-button T is pressed once and released, this action producing a reading which is maintained for a brief dwell period (i.e., 2 seconds). If however, the button is not released but is held in, the display automatically changes to provide a Minutes-Seconds reading which is continuously displayed until button T is released. No colon appears in the Minutes-Seconds display.

When Time-button T is depressed twice, another transition occurs and the Hours-Minutes presentation resulting from the first switching action is replaced with a Month-Date reading, but without the colon. When the Time-button is thereafter released, the Month-Date reading is then automatically terminated after a brief dwell period (i.e., after 1.5 seconds). Thus in the Time-mode, the operation is such that an automatic display cut-off takes place immediately or shortly after button T is released to return the watch to its Normal-mode. In no event is it possible in the Time-mode for the display to remain on more than 2 seconds after button T is released.

In the Set-mode, pressing and releasing Set-button S once will cause the Hours alone to appear on the display, as shown in FIG. 6. The Hours are presented by digits $D_1$ and $D_2$, followed by a colon. In addition, an A representing AM or a P representing PM will appear in digit $D_4$. This Hours setting display is continuous. If, while this display is on, Time-button T is pressed, each depression thereof will cause the Hours to advance one count. Hence to set Hours, one repeatedly presses Time-button T until the correct Hours reading appears on the display.

To set the Minutes, Set-button S is again pressed and released, at which point Minutes will be continuously displayed by digits $D_1$ and $D_2$, and Seconds by digits $D_3$ and $D_4$, with the colon C appearing between the Minutes and Seconds. If now the Time-button T is pressed, each depression will advance the Minutes counter 1 minute and the Seconds counter will be zeroed and stay zero until button T is released. This makes possible precise time synchronization to a time standard by simply holding button T depressed until the reference clock crosses zero seconds. The Minutes counter is inhibited, thereby preventing rollover when synchronizing seconds.

To set the Months, Set-button S is again pressed and released to cause the month to be displayed by display digits $D_1$ and $D_2$ to the left of the colon, as shown in FIG. 8. Each actuation of Time-button T will cause the Months counter to advance one month.

To set the Date, Set-button S is again pressed to cause the date to appear in display digits $D_3$ and $D_4$ to the right of the colon. Again, each actuation of Time-button T causes the Days counter to advance one day at a time.

So far, the Set-mode button has been pressed and released four times to permit, in sequence, the setting of the Hours, the Minutes, the Month and the Date. By pressing and releasing Set-button S a fifth time, all digits $D_1$ to $D_4$ are simultaneously turned on, with all segments thereof active, thereby displaying the number 88:88, as shown in FIG. 10. The purpose of this action is to test the display stations to be sure that all segments thereof are in proper working condition.

By pressing the Set-button a sixth time, the Set-mode circuit is reset so that the movement is returned to the Normal-mode and is in condition for a next setting cycle in which the first depression of the Set-button causes the Hours to be displayed.

As pointed out previously, regardless of how carelessly one operates Time-button T, the display will turn off automatically either upon release of the button or shortly thereafter. But in the Set-mode, the failure to go through all six steps and thereby return the display to the Normal mode after carrying out a particular setting operation may be fatal to the life of the batteries $B_1$ and $B_2$ powering the movement.

Thus if after actuating Set-mode button S three times to put the display in the Date setting state, one is distracted and fails to press this button three more times to return the watch to the Normal-mode, the display will then remain on in this state and current will be drawn continuously to maintain the LED display. As a consequence, the batteries will be exhausted in fairly short order.

The key feature of the present invention resides in an arrangement wherein the watch is caused automatically to revert to the Normal mode in a period running between one and two minutes after any setting action is entered. This period is sufficiently long to insure that the display will not turn off when the user is in the process of setting watch, for there is always at least one full minute from the last time the user presses Set-button S to the time that the display automatically turns off.

The Counters

Figure 11:
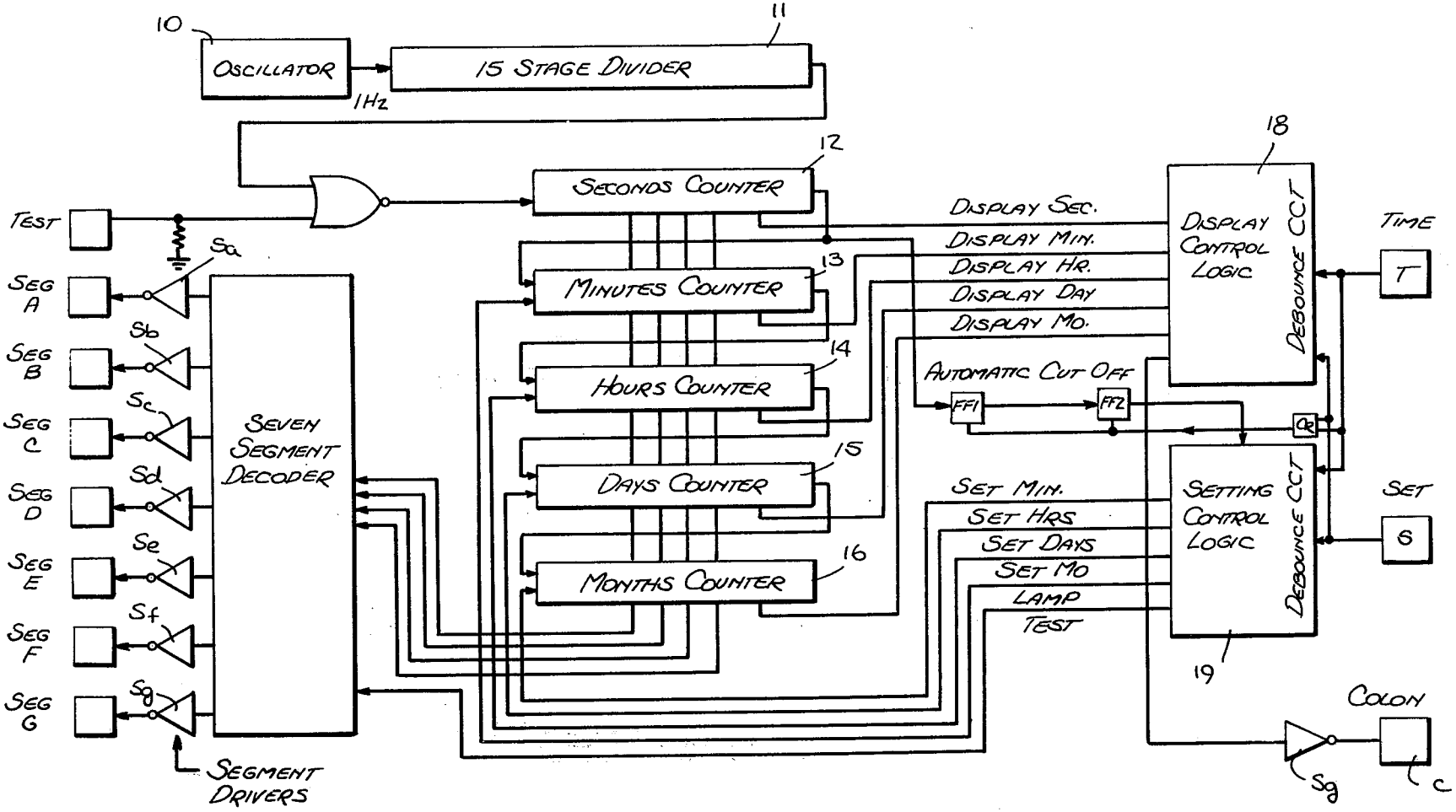
FIG. 11 is a block diagram of the electronic computer of the movement.

Referring now to FIG. 11, there is shown in block diagram the electronic time computer which provides signals for actuating the LED digit stations $D_1$, $D_2$, $D_3$ and $D_4$ of the display. The digit driver for these stations is omitted in this block diagram, but the segment drivers $S_a$ to $S_g$ for driving segments *a* to *g* of each station are shown. In the computer, the output of a crystal-controlled oscillator 10 having an operating frequency of 32,768 Hz is applied to a 15 stage frequency divider 11 to produce 1 $H_z$ timing pulses.

These 1 $H_z$ timing pulses are applied to a Seconds counter 12 which is incremented once per 1 $H_z$. The output of Seconds counter 12 is applied to a Minutes counter 13 which is incremented or rolled over each time the Seconds counter goes from 59 to 00. The output of Minutes counter 13 goes to an Hours counter 14 which is incremented each time the Minutes counter goes from 59 to 00.

The output of Hours counter 14 is applied to a Date counter 15 which is incremented each time the Hours counter goes from 23 to 24. In practice, an AM/PM counter (not shown) may be interposed between the Hours and Date counter, the AM/PM counter being incremented when the Hours counter goes from 11 to 12. AM or PM is displayed only during the Set-mode as previously described.

The output of Date counter 15 is applied to a Month counter 16 which is incremented each time the Data or unit days counter goes from 28 to 29, 30 to 31 or 31 to 32, this Date counter then resetting to zero. The Month counter goes from 1 to 12 and then resets. The counters are operatively coupled to a seven segment decoder 17 whose output is applied to segment drivers $S_a$ to $S_g$ coupled to the LED segments.

The Time mode switch button T is operatively coupled to a display control logic 18 which is connected to the counters whereby when this button is operated, the LED display stations present Hours-Minutes, Minutes-Seconds or Month-Date in the manner previously described.

The Set-mode button S is operatively coupled to a setting control logic 19, the arrangement being such that the first actuation of this switch makes possible Hours setting, the second actuation Minutes setting, the third actuation Months setting, the fourth actuation Date setting and the fifth actuation the testing of the four LED stations. The sixth actuation of Set-button S causes the system to return to the Normal mode. As previously explained, when Set-button S puts the system in the Minutes, Hours, Date or Month setting condition, a step-by-step advance of the reading entered thereby is effected by actuating the Time-mode switch button T.

The Automatic Cut-Off

In order to cause the system to revert to the Normal mode without having to actuate button S six times, an automatic cut-off circuit is provided which is designed to turn the LED display off if the watch is mistakenly left in any of the setting modes produced by actuation of button S one to five times. The cut-off circuit, as shown in greater detail in FIG. 12, is constituted by two flip-flops FF1 and FF2 in cascade relation operating in conjunction with an OR gate designated OR.

Buttons T and S are associated with conventional debounce circuits to allow, say, 32 milliseconds of bounce. The inputs of the OR gate are coupled to the debounce circuits of both buttons T and S so that if either of these buttons is actuated, the OR gate produces an output which is applied to the reset terminal R of both flip-flops FF1 and FF2 to reset these devices.

The first flip-flop FF1 is coupled to the rollover input of Minutes counter 13 and therefore has an input of one pulse per minute, the pulse appearing whenever the Seconds counter 12 goes from 59 to 00. Each flip-flop divides the frequency of its input by two and is reset whenever either button T or S is pressed.

The first flip-flop FF1 turns on when the first rollover input pulse appears and turns off when the succeeding input pulse appears. The second flip-flop FF2 is responsive to the turn-off action of the first flip-flop and is turned on thereby. The output of the second flip-flop FF2 is applied to the setting control logic 19, and when it is turned on, it causes the logic to return the watch to its Normal mode after a dwell period of 1 to 2 minutes following any setting action, provided that neither button T or S is pressed. There is always a minimum of one full minute from the last time the user presses a button to the time the cut-off circuit brings about automatic turn-off of the display.

We shall now consider the outputs of flip-flop FF1 and FF2 in the Set-mode for setting either Hours, Months or Days. As shown in the timing diagram in FIG. 13, in wave form A thereof, applied to the input of the flip-flop FF1 are the square-wave minutes rollover pulses.

The momentary action of Set-button S is shown in form B, the brief duration of the Set-button pulse depending on the time between press and release. Similarly, the momentary action of the Time-button T is shown in form C. The output of flip-flop FF1 is shown in form D and that of flip-flop FF2 in form E. The instant the second flip-flop turns on, as represented by the leading edge of the output of FF2 which is coincident with the trailing edge of the second pulse in the FF1 output, the display is turned off and then functions in its Normal mode.

Whenever either Set-button S is actuated or Time-button T is actuated, as indicated in forms B and C, both flip-flops are reset to restart the flip-flop cycle. If, for example, the seconds counter is at 50 as a particular Set-mode is entered by Set-button S (Hours, Months or Days), flip-flop FF1 will turn on 10 seconds later when the seconds go from 59 to 00. The second flip-flop FF2 will turn on 60 seconds thereafter.

In general, this dwell time is equal to the period extending between the last-time a button (T or S) is pressed to the next time the minutes rollover. This dwell time is indicated in form D in FIG. 13 by the variable interval $T_1$ plus a full minute period, as indicated by the fixed interval $T_2$. The interval $T_1$ has a miximum of 1 minute, hence the dwell time is between 1 and 2 minutes.

A special case exists for setting of the minutes, as shown in FIG. 14, for when Set-button S is pressed to place the movement in the minutes setting mode and the minutes are thereafter updated by pressing the Time-button, this action causes the seconds counter to reset to 00. As a consequence, the first flip-flop FF1 turns on 60 seconds later and the second flip-flop FF2 turns on 60 seconds thereafter. Thus in the minutes setting mode, the dwell period is always 2 minutes, after which the display reverts to the Normal mode.

While there has been shown and described a preferred embodiment of an automatic cut-off setting system for LED display in a solid-state watch, it will be appreciated that many changes and modifications may be made therein without, however, departing from the essential spirit thereof.

We claim:

1. In a battery-operated multi-function electronic watch having a display formed by several light-emitting diode stations, the combination comprising:

A. a miniature electonic computer having a time base, a frequency divider coupled to said time base to produce low-frequency timing pulses and counters responsive to said pulses for producing signals which are decoded to actuate said stations, said stations normally being in a Normal-mode in which all stations are unactuated;

B. manually-operated releasable switching means associated with said computer for effecting in a Time-mode the selective actuation of said stations to present Hours-Minutes and other Time-mode functions and in a Set-mode to individually present the various readings constituting said functions, said switching means being constituted by a Time-mode button which when pressed and released in a particular manner produces said Time-mode functions, and a Set-mode button which when repeatedly pressed and released in a particular manner sequentially produces said readings to be set, said readings being thereafter updated by operation of said Time-mode button; and C. automatic cut-off means associated with said switching means and acting both in the Time-mode and in the Set-mode to cause said display to revert to said normal-mode when said switching means are released or shortly thereafter.

2. The combinations as set forth in claim 1, wherein said counters include a Seconds counter whose output is applied to a Minutes counter whose ouput is applied to an Hours counter whose output is applied to a Days counter whose output is applied to a Months counter, whereby said watch functions are Hours-Minutes, Minutes-Seconds and Date-Months.

3. The combination as set forth in claim 1, wherein each of said stations is formed by seven segments and the signals are decoded by a seven-segment decoder.

4. The combination as set forth in claim 3, wherein the decoder output is applied to the segments of the stations through respective segment drivers.

5. The combination as set forth in claim 2, wherein said means causing the display to revert to the Normal-mode includes an automatic cut-off circuit which is responsive to the output of said Seconds counter to produce a cut-off signal within a predetermined period.

6. The combination as set forth in claim 5, wherein said cut-off circuit includes two flip-flops in cascade relation.

7. The combination as set forth in claim 6, further including an OR gate operated by either the Time-mode or the Set-mode button and coupled to said flip-flops to reset same.

* * * * *